US005613805A

United States Patent [19]

Schmid

[11] Patent Number: 5,613,805

[45] Date of Patent: Mar. 25, 1997

[54] DEVICE FOR CLEANING CONTAMINATED TOPSOIL

[75] Inventor: Jürgen T. Schmid, Rottweil, Germany

[73] Assignee: Filter-und Wassertechnik GmbH, Dunningen-Seedorf, Germany

[21] Appl. No.: 374,643

[22] PCT Filed: Jul. 21, 1993

[86] PCT No.: PCT/EP93/01928

§ 371 Date: Jan. 30, 1995

§ 102(e) Date: Jan. 30, 1995

[87] PCT Pub. No.: WO94/03236

PCT Pub. Date: Feb. 17, 1994

[30] Foreign Application Priority Data

Jul. 30, 1992 [DE] Germany ..... 42 25 125.7

[51] Int. Cl.[6] ..... B09B 3/00

[52] U.S. Cl. ..... 405/128; 210/170; 210/747; 405/258; 588/249

[58] Field of Search ..... 405/128, 129, 405/131, 258; 210/170, 747, 751, 758; 166/50, 59, 265, 266, 370, 372; 588/249

[56] References Cited

U.S. PATENT DOCUMENTS

| | | | |
|---|---|---|---|
| 5,011,329 | 4/1991 | Nelson et al. | 405/128 |
| 5,160,217 | 11/1992 | Metzer et al. | 405/128 |
| 5,178,491 | 1/1993 | Graves et al. | 405/128 |
| 5,178,823 | 1/1993 | Hughes . | |
| 5,180,503 | 1/1993 | Gorelick et al. | 405/128 X |
| 5,188,041 | 2/1993 | Noland et al. | 405/128 X |
| 5,246,309 | 9/1993 | Hobby | 405/128 |
| 5,271,693 | 12/1993 | Johnson et al. | 405/128 |
| 5,318,116 | 6/1994 | Vinegar et al. | 405/128 X |
| 5,387,057 | 2/1995 | Deloach | 405/128 |

FOREIGN PATENT DOCUMENTS

| | | |
|---|---|---|
| 3448123C2 | 1/1986 | Germany . |
| 68807065.4 | 9/1991 | Germany . |
| 4104989A1 | 11/1991 | Germany . |
| AU90/00391 | 3/1991 | WIPO . |

OTHER PUBLICATIONS

Vakuumpumpen und verdichter siemens–system Elmo–f, undated.

12 Jul. 1963; Siemens; Elmo–Gaspumpen.

Dialog Information Services, File 621, PTS New Product Announcements(R), Dialog accession No. 0264840, Date line, News Release, Slam joad, CT, May 25, 1990.

"Package Vacuum Pump Systems For Soil Venting Applications Introduced By Atlantic Fluidics, Inc.".

Siemens Zeitschrift, 1959 (Apr.), Neue Anwendungsgebiete der Elmo–Vakuumpumpe mit Gasstrahler.

Dräger–Röhrchen, Publication Advertisement by Drager Aug., 1989.

*Primary Examiner*—Dennis L. Taylor

*Attorney, Agent, or Firm*—Griffin, Butler Whisenhunt & Kurtossy

[57] ABSTRACT

In an apparatus for aspirating gases, in particular from topsoil, an effective explosion protection can be attained by having a negative-pressure fan or negative-pressure generator formed as a water-ring pump.

9 Claims, 3 Drawing Sheets

DEVICE FOR CLEANING CONTAMINATED TOPSOIL

DESCRIPTION

Figure 1:
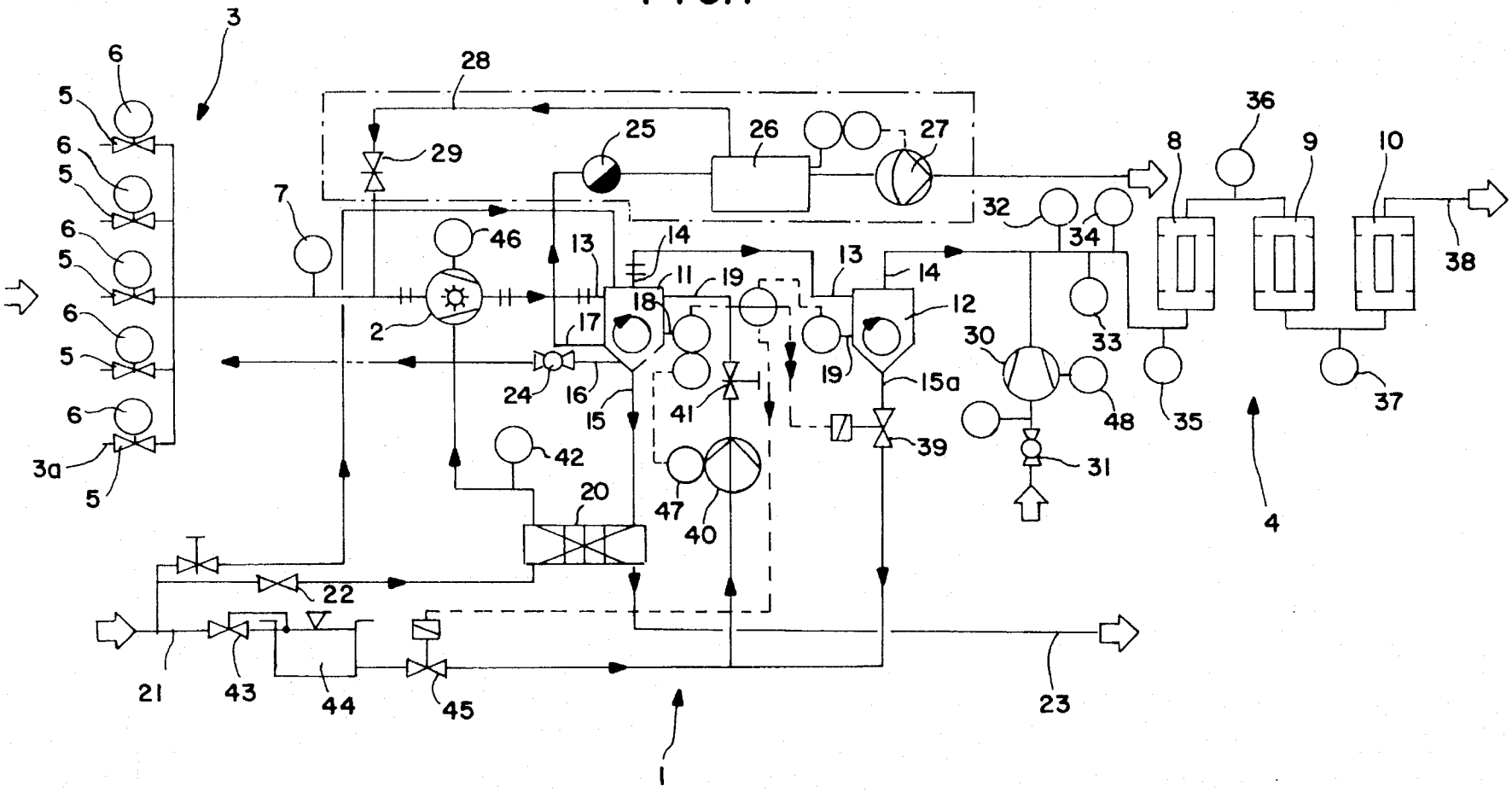

The invention concerns a cleaning apparatus for contaminated topsoil with a suction element installable in or on the topsoil having at least one downstream negative-pressure generator.

Cleaning apparatus, particularly soil-air aspirating equipment are generally well-known. This aspirating equipment is particularly used to aspirate readily-volatile materials from contaminated soil. For this purpose, the apparatus includes a side-channel compressor which can generate a negative pressure from 250 to 300 mbar, however with a maximal negative pressure of 500 mbar. In this regard, it has indeed proven that readily-volatile gases, particularly aromatic compositions can be aspirated fairly well. However, a volume flow decreases sharply with increasing negative-pressure so that an effective aspiration after a certain negative-pressure is no longer possible. Because of these circumstances, non-readily-volatile fluids, fluid mixtures and saturated vapors, cannot be aspirated. Further, in order to have an effective aspiration, the surface of the soil at an area about an aspiration point must be completely sealed, otherwise air sucked in above the soil surface detracts from aspirating gases from the soil interior.

It has proven to be a further disadvantage that with such soil aspirators explosive gases cannot be aspirated because such devices do not offer an explosion-protection guarantee. If, for example, quartz particles are also aspirated from the soil via the aspirating element the danger arises that these quartz particles can effect spark production in the side-channel compressor which can ignite an explosive gas or gas mixture. An explosion of the entire installation would be unavoidable. An enlargement of an impeller gap in the side-channel compressor, whereby spark generation can be reduced, is not possible because then a reduced negative pressure would be attainable. Employment of such a soil air aspirator in a danger zone would only be possible with employment of expensive measures, such as explosion valves (and the like) or comprehensive fragment-proof protection.

It is an object of this invention to provide an apparatus of the type described in the above introduction that allows attainment of higher negative-pressures, while at the same time preventing the danger of spark generation and achieving effective cleaning of aspirated gases.

According to principles of this invention this object is achieved by forming the negative-pressure generator as a liquid seal ring pump to which is coupled, downstream thereof, a polluting-material removing activated-charcoal filter for air, with, at least one fluid trap being coupled intermediate the liquid seal ring pump and the polluting-material removing activated-charcoal filter for air.

By employing a liquid-, or water seal ring pump, spaces between individual ring cells can be effectively sealed whereby extreme negative pressures are attainable. The spaces in the liquid ring have the further benefit that no spark generation can be effected by quartz particles aspirated from the soil because this process would take place in a water ring and therefore separate from explosive gases. Thus, explosive and/or ignitable gas-air mixtures can be conveyed from tanks, buildings or top soil so that the soil can be stored in silos or containers. Absolute pressures to 33 mbar can be achieved with a liquid seal ring pump. In an activated-charcoal filter for air downstream of the liquid seal ring pump the polluting-material will be removed and either collected or converted into non-damaging-material.

With the aspiration equipment of this invention, which can be beneficially employed as a soil-air aspirating installation, because of its extreme high negative-pressure, not only readily-volatile, but also medium-and non-readily-volatile compositions, such as aromatic and/or chlorinated hydrocarbons can be aspirated such as Benzene, Toluene, Xylene, Trichlorethylene, Perchlorethylene, and the like. Further, the apparatus can also be put in operation for strongly cohesive soil and/or water saturated soil zones, with good aspiration results. Finally, water which is carried by aspirated gas does not pose a problem for the negative-pressure generator. It can, in fact, suck in only liquid if measures are taken on the input side which bring about such a strong pressure gradation at a jet nozzle that a conveying threshold is overcome. With an apparatus of this invention corrective measures can be quickly carried out.

By means of the activated-charcoal filter for air an optimal cleaning of the air aspirated from the topsoil can be attained, with the polluting-material being adsorbed by the activated-charcoal. The saturated activated-charcoal can then be replaced in an uncomplicated manner by fresh receptive-capable charcoal, a gas coming from the liquid seal ring pump, which has a relative humidity of almost 100% is dehumidified by the fluid trap so that fluid particles carried with the airstream are separated therefrom. In this manner the adsorption ability of the activated-charcoal filter for air is not decreased by thusly transported water.

It is beneficial that the fluid trap is formed as a cyclone separator. With a cyclone separator an effective mechanical separation of liquid particles from a gas stream is accomplished with the cyclone separator functioning maintenance-free.

Preferably, at least two liquid traps are provided with at least the downstream one having a full body packing, particularly with polypropylene. With this full body packing the separation operation is improved. In order to control, and possibly to exhaust, the amount of separated liquid, the liquid separator is provided with a "full" sensor as well as an emptying valve. A liquid supply into the liquid ring of the liquid seal ring pump is, depending on necessity, achieved by having the liquid ring of the liquid seal ring pump coupled with a liquid outlet of the liquid separator. In this manner the liquid carried with the gas coming from the pump, which is separated by the liquid separator, is again supplied to the water seal ring pump. The effective liquid loss is limited to a minimum in this manner. Further, the liquid which is contaminated by the aspirated gas is held in a closed circuit.

In order to prevent an undue warming of the fluid of the liquid ring, a heat exchanger is interconnected between the liquid seal ring pump and the liquid trap. This heat exchanger can be cooled by fresh water or by environmental air.

It is beneficial to have an overflow of the fluid trap coupled with a liquid container and in particular with an activated-charcoal filter for liquid. Liquid exiting from the liquid trap can be collected in the liquid container and it can be processed in the activated-charcoal filter for liquid so that it can be released to the atmosphere without further consideration. Also in this manner, particularly liquids carried with gases aspirated from topsoil can be processed. This liquid is, in the rule, as is the aspirated gas, contaminated and requires the processing of going through an activated-charcoal filter for liquid.

It is preferable to provide a throttling valve for supplying fresh air upstream of the polluting-material receiving apparatus. In this manner, the humidity of air supplied to the polluting-material receiving apparatus can be decreased, particularly if the supplied fresh air is first warmed. In this manner, the adsorption process in the activated-charcoal filter for air can be accelerated.

For guiding and controlling the entire apparatus, temperature, pressure, and humidity measuring devices, as well as a polluting-material measuring device, particularly with the help of "DRAEGER" tubes, are beneficially provided. With these instruments improper functioning of individual installation parts as well as deviations of individual system values can be quickly detected and an intervening control can be brought to bear in the process so that optimal and effective continuous air aspiration over the long haul, that is for weeks and months, can be maintained.

In a particular embodiment it is provided that the apparatus be formed as a mobile installation. Mobile installations can be moved to their operation sites in the least amount of time, which is particularly important for accidents where toxic material is introduced into soil. Such installations are helpful for minimizing damage and contribute particularly to a quick decontamination of the soil.

Figure 2:
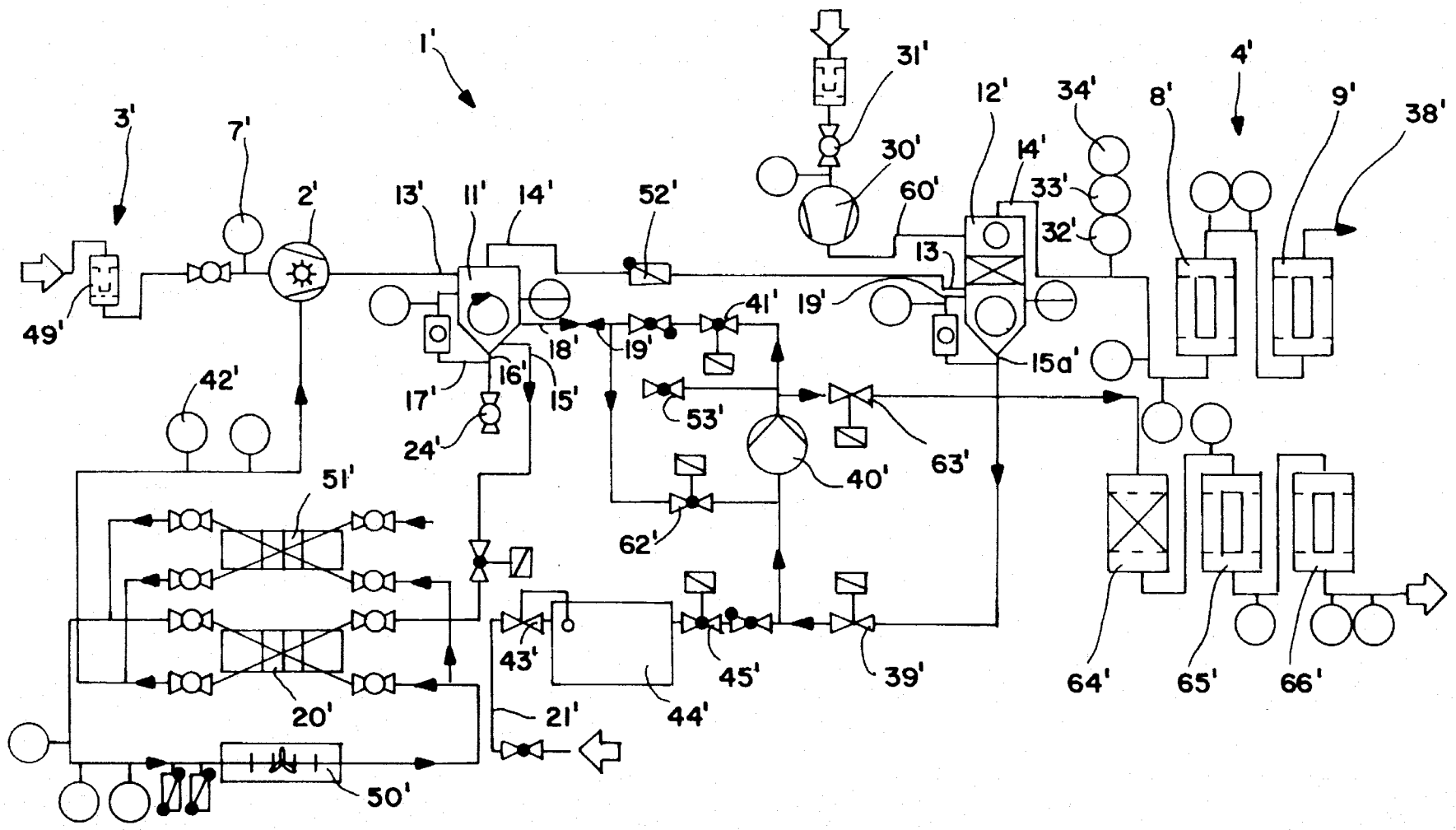
Figure 3:
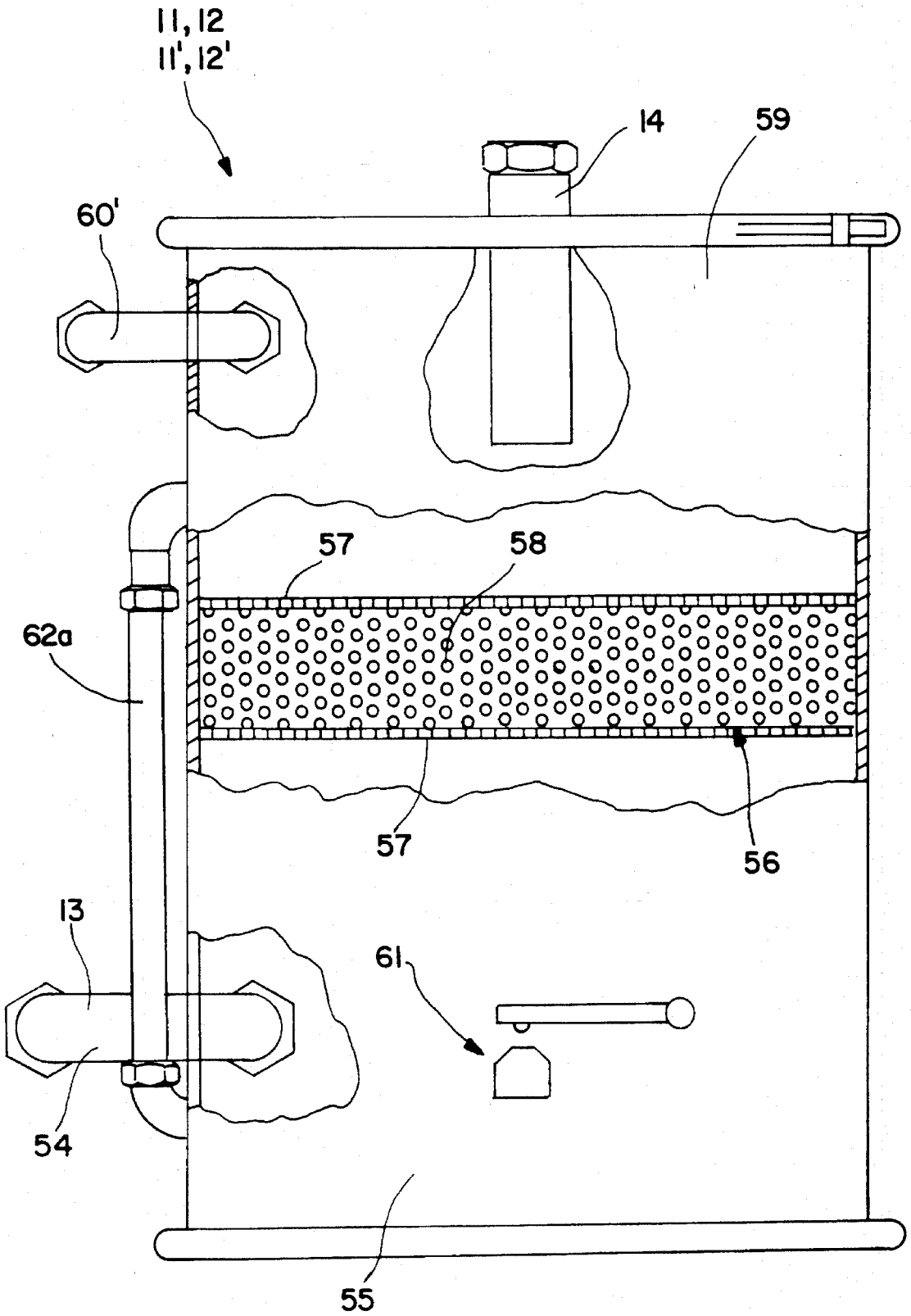

Further benefits, characteristics, and details of the invention are contained in the following description in which, with reference to the drawings, two particularly preferred embodiments are described in detail. Thereby shown:

FIG. 1 a first process schematic of an apparatus according to this invention;

FIG. 2 a second process schematic of an apparatus according to this invention; and FIG. 3 a separator.

The apparatus for aspirating fluids, from topsoil shown in FIGS. 1 and 2, and identified generally with the reference numeral 1, has as a main element a liquid-, or water seal ring, pump 2 which is arranged between a suction element, indicated generally by the reference numeral 3, and a device to receive damaging material, indicated generally by the reference numeral 4. The suction element 3 comprises, normally, a plurality of rods that are placed in the soil (not shown), with which ground air is sucked via valves 5. However, liquids or gas-liquid mixtures can be aspirated via the rods. Each rod can, independently from the other rods, lie in ground water or above ground water. Thus, the individual absolute pressures of the individual ground-air rods at the measuring-and-controlling positions 6 and a vacuum overall pressure at a measuring-and-controlling position 7, between the valve 5 and the water seal ring pump 2, are read. In the rule, the rods are inserted into the soil in a rod borehole with the rod borehole being sealed at its lower and upper ends. A sucking of fluids takes place via a filter pipe which lies between two and twenty meters below the surface of the soil. The spacings of individual rod boreholes can be fifty to sixty meters. For largely gravel-and sand-content ground, the soil surface can possibly be covered, or sealed, by a foil. The filter pipes can feed into a water surge tank 49 (FIG. 2) which is integrated into the installation. In this manner, protection against explosions is improved. Transported dirt particles will be separated in this water surge tank 49, thus, it serves as a sedimentation stage. Further, it has the function of a flame prevention filter. By mounting a bursting disc on a head of the water surge tank, it provides a safety function for detonations.

The aspirated gases passing through the water seal ring pump 2 leave the pump at a temperature of around 25° C. and with a relative humidity of almost 100%. The device 4 for removing polluting-material is formed as activated-charcoal filter for air, whereby two or three filter columns 8, 9 and 10 are arranged one after the other. Because air humidity of the aspirated gases for the activated-charcoal in the air filter columns should not be over 60 to 70% and the temperature of the gases likewise should not be very high, the device 4 is coupled downstream of two fluid traps 11 and 12. The fluid trap 11 is formed as a cyclone separator. They have, in addition to an input 13 and an output 14 for gas to be dried, outputs 15 through 18 for separated liquid as well as an input 19 for fresh water or, in the embodiment of FIG. 2, for subsequent filling. The output 15 is coupled via a heat exchanger 20 with a water ring of the water seal ring pump 2. The heat exchanger communicates via a valve 22 with a fresh water line 21 for cooling and is coupled to a fresh water drain 23. In FIG. 2 the heat exchanger 20 is coupled to a cold water reserve 50 for additional cooling so that the installation, upon a water shortage or for saving fresh water, can produce the necessary cooling by means of electrical energy. A further heat exchanger 51 can also be provided. Via a valve 24 the output 16 leads into a receiving container (not shown) for the separated liquid. The output 17 leads, according to the embodiment of FIG. 1, via a water separator 25, into a container 26 from which incoming water, upon a maximum "full" condition be achieved, is supplied by a membrane pump 27 to an activated-charcoal filter for water in which polluting-material is separated. Further, the container 26 has a ventilation line 28 which communicates with a relief valve 29 which is coupled to a sucking side of the water seal ring pump 2. In the embodiment of FIG. 2 the output 17 is coupled back to the trap 11.

The soil air that leaves both of the fluid traps 11 and 12 is freed from water droplets and can, depending upon need, be mixed with warm fresh air by means of a fan 30. In the embodiment of FIG. 2 a housing 30 opens into an upper release area of the trap 12. The amount of fresh air can be adjusted by a regulating valve 31 which is controlled by a humidity measuring device 32. Further, the temperature of gases entering the device 4 can be measured by a measuring device 33. The pressure of the entering gas is measured by a measuring device 34. The filter columns 8, 9 and 10 have test probe positions, 35, 36 and 37 whereby the hydrocarbon and the chlorinated hydrocarbon content of the soil air, with the help of "DRAEGER" tubes can be measured at the test position 35. At the test positions 36 and 37 the remaining content of the hydrocarbon and chlorinated hydrocarbon of the filter air is measured. The gas exhausting from the output 38 can be released into the environment without further measures.

The fluid trap 11 is so constructed that soil air which is mixed with circulated water in the water seal ring pump 2, and possibly with ground water, is separated from the liquid and led to the downstream connected fluid trap 12 in which any remaining transported water droplets are separated. The fluid trap 12 has a full body packing of polypropylene to improve separation effectiveness. The output 15 is provided with a float activated switch and an emptying valve 39, which is coupled via a pump 40 and a valve 41 with the input 19 of the fluid separator 11. Because during operation of the water seal ring pump 2 water is continually picked up from the water ring by conveyed gas, the water ring is fed exhausted liquid from the fluid trap 11 via the output 15 and the heat exchanger 20 (which is formed as a plate heat exchanger and whose exit temperature is controlled by a temperature measuring device 42). For replenishing the circulating water, water is taken from the fresh water line 21 and led to a precontainer 44 via a level-regulated, float-controlled, valve 43. From here the water flows to the pump 40, via an emptying valve 45 with a float activated switch, from which it is fed to the fluid separator 11. If there is sufficient fluid in the fluid separator 12 then the valve 39 opens otherwise, the valve 45 opens.

Between the traps 11 and 12 there is a check valve 52 which, upon a failure of the water seal ring pump 2, prevents a reverse flow of air from the fan 30 via the separator 12 to the separator 11.

If the water seal ring pump 2 sucks water in then the level in the separator 11 is raised. In order to lead the water away, two magnetic valves 62 and 63 open so that the water can be fed via the pump 40 to a sand filter 64 and to downstream connected water activated-charcoal filters 65 and 66 for water.

The pump 40 is provided with a valve 53 with which it can be ventilated upon placing it in operation.

Drives 46, 47 and 48 of the water pump 2, the pump 40, and the fan 30 can be electric motors and/or combustion engines. Preferably, the drives, as well as measuring devices and valves, are coupled to a control apparatus which monitors all of the measured data and, upon deviations from desired values, automatically controls the appropriate valves and drives. In this manner, the apparatus 1 is constructed for an automatic continuous operation so that it continuously functions in an optimal, or in a predetermined, working range without supervising personnel. Even when explosive ground gases are sucked in, there is no danger of an explosion with the apparatus of this invention and no special precautions must be taken because moving elements which could create sparks continuously move in the water ring of the water seal ring pump 2. An ignition of the explosive gases is therefore eliminated.

In FIG. 3 a fluid trap is shown which could be employed, for example, as the fluid trap 11 or 12. A water-vapor-saturated air of the water seal ring pump 2 is further processed by the separator 11 in that it is led by a pipe line 54 tangentially into a lower part 55 and, by means of radial acceleration, freed of water particles which can be created by condensation in previously connected lines. Above the lower part 55 of the substantially circular cylindrical trap, in particular in the upper half or in the upper one third, there is an activated-charcoal packed bed 56. This includes two parallel mesh walls 57 between which there is an activated-charcoal fill 58. This activated-charcoal packed bed 56 is permeated by rising air. Should there still be further condensation present, the activated-charcoal removes this water and releases it later in a controlled manner as water vapor to through-flowing air. A mixing chamber 59 is located above the activated-charcoal packed bed 56 in which hot dry air of the fan 30 is mixed via the line 60 with moist air which exits from the packed bed 56. The mixture is likewise accomplished by tangentially blowing in the hot mix air. In the lower part 55 a float activated switch 61 can be seen. Further, a site glass 62 is provided externally of the separator for determining its contents.

We claim:

1. Cleaning apparatus for contaminated soil comprising an intake suction element (3) for being positioned at the soil, with at least one downstream negative-pressure generator comprised of a liquid seal ring pump (2) to which is connected, downstream thereof, a polluting-material-removing activated-charcoal filter for air (8 through 10), wherein at least first and second fluid traps (11 and 12) are serially interposed between the liquid seal ring pump (2) and the polluting-material-removing activated-charcoal filter for air (8 through 10) with the second fluid trap being downstream of said first fluid trap and having a filling body packing therein.

2. Apparatus as in claim 1 wherein the intake suction element is a plurality of rods for being inserted into the soil, and wherein the liquid seal ring pump (7) is coupled to at least some of the rods, with the rods, being arranged such that some of the rods can be placed in ground water while some of the rods can be placed above ground water.

3. Apparatus as in claim 1 wherein a liquid container (26) and an activated-charcoal filter for liquid, are connected to the first liquid trap (11).

4. Apparatus as in claim 1 wherein a regulating valve (31) as well as a fan (30) for supplying fresh air is provided upstream of the activated-charcoal filter for air (8 through 10) for the removal of polluting-material.

5. Apparatus as in claim 1 wherein temperature, pressure, and humidity measuring devices as well as polluting-material measuring devices, comprising "DRAEGER" tubes, are provided.

6. Apparatus as in claim 1 wherein the cleaning apparatus (1) is formed as a mobile installation.

7. Apparatus as in claim 1 wherein the upstream trap of said first and second fluid traps (11 and 12) includes a packed activated-charcoal bed (56) therein.

8. Apparatus as in claim 7 wherein below the activated-charcoal filter bed (56) there is a tangentially-arranged air input line (13) for providing air into the upstream liquid trap, and above the activated-charcoal bed (56) there is a mixing chamber.

9. Apparatus as in claim 1 wherein said filling body packing is formed of polypropylene.

* * * * *